US005244046A

United States Patent [19]

Council et al.

[11] Patent Number: 5,244,046

[45] Date of Patent: Sep. 14, 1993

[54] COILED TUBING DRILLING AND SERVICE UNIT AND METHOD FOR OIL AND GAS WELLS

[75] Inventors: Malcolm N. Council, Richardson; William H. McCormick, Plano, both of Tex.

[73] Assignee: Otis Engineering Corporation, Dallas, Tex.

[21] Appl. No.: 937,484

[22] Filed: Aug. 28, 1992

[51] Int. Cl.[5] ..... E21B 33/00

[52] U.S. Cl. ..... 166/380; 166/84

[58] Field of Search ..... 166/380, 386, 387, 82–84, 166/86

[56] References Cited

U.S. PATENT DOCUMENTS 3,827,487 8/1974 Jackson et al. .
4,147,215 4/1979 Hodge et al. ..... 166/77.5 X
4,512,410 4/1985 Forester ..... 166/380
4,515,220 5/1985 Sizer et al. .
4,552,213 11/1985 Boyd et al. ..... 166/380 X
4,655,291 3/1987 Cox .
4,940,095 7/1990 Newman .

*Primary Examiner*—Thuy M. Bui
*Attorney, Agent, or Firm*—Warren B. Kice

[57] ABSTRACT

A coiled tubing service unit and method for oil and gas wells including a string of components extending above ground in coaxial alignment with said well and including an injector for injecting coiled tubing into the well and a sealing unit for preventing the flow of pressurized oil and gas from the well. The sealing unit is adapted to be disconnected from the string of components and removed from the coaxial alignment to permit a relatively large-diameter tool assembly to be inserted therein. The sealing unit can then be repositioned and connected in the string of components and the coiled tubing can be reinserted into the string, connected to the tool and driven into the well.

22 Claims, 3 Drawing Sheets

COILED TUBING DRILLING AND SERVICE UNIT AND METHOD FOR OIL AND GAS WELLS

BACKGROUND OF THE INVENTION

This invention relates to a coiled tubing drilling and service unit and method and, more particularly, to such a unit and method for running both wireline and coiled tubing into and from the bore of a high pressure oil and gas well.

A great variety of well servicing operations are routinely performed inside well production tubing by various devices attached to a wireline. Also, production flow control devices are installed in and removed from the tubing when necessary, by special tools attached to the end of a wireline.

Although wireline tool operations are still in widespread use, the use of coiled, or reeled tubing is becoming more popular since it enjoys advantages over wireline in certain operations. For example, coiled tubing can be used in connection with highly deviated or horizontal well completions since the coiled tubing does not rely on gravity for setting and retrieval of downhole devices. Coiled tubing has also proven to be advantageous from a time and money saving standpoint in connection with sand washing, fluid displacement, removal of paraffin, squeeze cementing, spotting acid, light duty drilling of cement and the like, fishing operations, and flow line clean out. With the recent availability of large diameter coiled tubing, increasingly heavier duty well drilling, servicing and completion operations are possible.

Since wireline and coiled tubing operations both enjoy separate and distinct advantages, it often is desirable to utilize both wireline and coiled tubing to service the same wells. For example, in some applications coiled tubing is used initially for performing washing and/or drilling functions in the wellbore, after which wireline tools are inserted into the wellbore for performing pressure surveys or pulling various flow control devices. In this example, a coiled tubing rig would initially be assembled over the wellbore, and would include a coiled tubing injector extending over a stripper, or stuffing box which, in turn, is connected to a blow-out preventor, or the like. A goose neck, or tubing guide, is usually connected to the upper portion of the injector for guiding the coiled tubing into the injector which forces the coiled tubing through the stripper and the blow-out preventor into the pressurized wellbore. However, the wireline and coiled tubing tools usually have a diameter greater than that of the coiled tubing and often have to be inserted in a pressure containing lubricator which has an even greater diameter. Therefore, since the strippers associated with the coiled tubing rig are often not large enough to receive the tools, the coiled tubing rig has to be disassembled, and the components necessary to guide the wireline or coiled tubing tools and their lubricators into the wellbore have to be assembled over the wellbore. These latter components usually include blow-out preventors and a lubricator assembly consisting of one or more sections to accommodate the tools being used. It is apparent that the disassembly of the coiled tubing rig and the assembly of other equipment above a high pressure well is time consuming and gives rise to potential equipment handling accidents.

The terms "coiled tubing tools" and "wireline tools" apply to a broad range of devices that can be usefully attached to coiled tubing or wireline for various processes including, but not limited to, drilling, logging, inspection, cleaning, completion and other routine well servicing operations.

SUMMARY OF THE INVENTION

It is therefore an object of the present invention to provide an service unit and method for inserting and removing both coiled tubing and wireline tools from a wellbore utilizing essentially the same rig.

It is a further object of the present invention to provide an unit and method of the above type which reduces labor and costs associated with disassembling and reassembling the separate rigs normally associated with coiled tubing operations and wireline tool operations.

It is a further the object of the present invention to provide an unit and method of the above type in which the major components normally utilized in connection with the coiled tubing operation can be maintained in place during the wireline operation.

It is a further object of the present invention to provide a unit and method of the close type which includes modular components which can be added, deleted or interchanged as desired.

Toward the fulfillment of these and other objects the service unit of the present invention includes a telescoping tube assembly and a stripper which form part of a service unit and which can be removed from the unit to permit a wireline tool to be inserted into the unit and injected into the wellbore. The tube assembly and the stripper can be easily reconnected to the unit to permit the unit to be used with coiled tubing, coiled tubing tools and wireline tools in a safe and expeditious manner.

BRIEF DESCRIPTION OF THE DRAWINGS

The above description, as well as further objects, features and advantages of the present invention will be more fully appreciated by reference to the following detailed description of the presently preferred but nonetheless illustrated embodiments in accordance with the present invention when taken injunction with the accompanying drawings wherein.

DESCRIPTION OF THE PREFERRED EMBODIMENT

Figure 1:
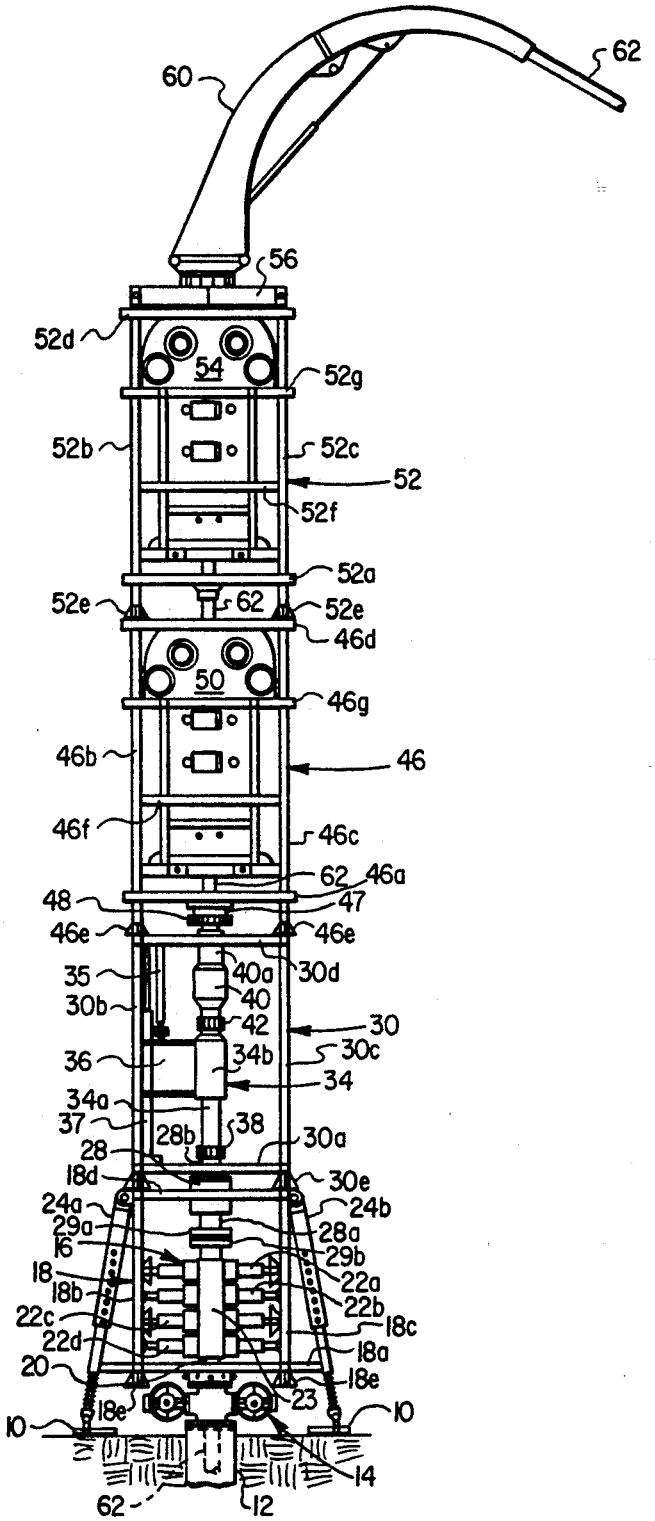
FIG. 1 is a front elevational view depicting the service unit of the present invention.

FIG. 1 of the drawings depicts the service unit of the present invention which includes a plurality of outrigger pads 10 which rest on the ground and extend around a wellbore 12 extending from ground surface to a predetermined depth in the earth. A master valve assembly 14 is mounted on the wellbore 12 and is coaxially aligned with the wellbore 12. The valve assembly 14 includes one or more valves which control the flow of production fluid from the wellbore 12 in a conventional manner.

A blow-out preventor 16 extends over the valve assembly 14 and within a frame assembly 18 consisting of a base member 18*a* which rests on the upper surface of the valve assembly 14, four upright members, two of which are shown by the reference numerals 18*b* and 18*c*, and an upper frame member 18*d*. The upper and lower end portions of the upright members, including members 18*b* and 18*c*, project above and below the upper frame member 18*d* and the base member 18*a*, respectively, and a cap 18*e* is provided on the lower end of each upright member for reasons to be described. The base member 18*a* defines a central opening (not shown) through which a nipple 20 extends to connect the valve assembly 14 in coaxial alignment with the blow-out preventor 16.

The blow-out preventor 16 consists of four or more ram members 22*a*-22*d* extending from either side of a central tubular member 23 in communication with the nipple 20. Since the ram members 22*a*-22*d* and the tubular member 23 operate in a conventional manner to selectively seal off, or prevent the flow of, pressurized well fluid from the wellbore 12, they will not be described in any further detail.

A series of struts, two of which are shown by the reference numerals 24*a* and 24*b* extend from the outrigger base 10 upwardly to the upper frame member 18*d* of the frame assembly 18 and are connected to the latter member as well as to the base member 18*a* for supporting the blow-out preventor 16 and the components to be described.

An annular blow-out preventor 28 extends over the upper tube member 23 in coaxial alignment therewith with the lower portion of the blow-out preventor 28 extending within the frame assembly 18 and the upper portion extending above the upper frame member 18*d*. Two nipples 28*a* and 28*b* extend from the lower and upper ends, respectively, of the blow-out preventor 28 and two flanges 29*a* and 29*b* respectively extend from the nipple 28*a* and the tubular member 23 and are connected together in any known manner to secure the blow-out preventor 28 to the tube member 23. The end portion of the nipple 28*b* is externally threaded for reasons to be explained. Since the blow-out preventor 28 operates in a conventional manner to seal off, or prevent, the flow of pressurized well fluid upwardly from the wellbore 12, it will not be described in any further detail.

A frame assembly 30 extends above the frame assembly 18 and consists of a base member 30*a*, four upright members, two of which are shown by the reference numerals 30*b* and 30*c*, and a upper frame member 30*d*. The upper end portions of the upright members, including members 30*b* and 30*c*, project above the frame member 30*d* and the lower end portions of the upright members, including members 30*b* and 30*c*, project below the base member 30*a*. Four caps 30*e* are connected to the respective lower ends of the upright members, including members 18*b* and 18*c*, and extend over the corresponding upwardly projecting end portions of the upright members, including members 18*b* and 18*c*, of the frame assembly 18. The caps 30*e* are secured to the upper ends of the upright members, including members 18*b* and 18*c* in any conventional manner such as by a pin extending through aligned openings or slots.

The nipple 28*b* of the blow-out preventor 28 extends through the base member 30*a* of the frame assembly 30, and a tube assembly 34 extends above the nipple 28*b* and within the frame assembly 30. The tube assembly 34 includes a telescoping joint 34*a* extending within a tube guide 34*b* and adapted for telescoping movement relative thereto in a conventional manner. To this end a hydraulic ram 35 is provided having one end secured to the upper frame member 30*d* and the other end secured to a plate 36 extending from the tube guide 34*b*. Thus, contraction of the ram 35 causes retracting, telescoping movement of the tube guide 34*b* relative to the telescoping joint 34*a*. A vertical beam 37 extends between the base member 30*a* and the upper frame member 30*b* and receives the plate 36 to permit pivotal and axial movement of the plate 36, such as providing a tube or cylinder at the end of the plate 36 which receives the beam 37, in a conventional manner.

A connector 38 extends from the telescoping joint 34*a* and is adapted to engage the externally threaded nipple 28*b* to connect the telescoping tube assembly 34 in coaxial alignment with the annular blow-out preventor 28. A stuffing box, or stripper 40 is also disposed within the frame assembly 30 and is connected in coaxial alignment with the tube assembly 34 by a connector 42 which extends from the stripper 40 and engages an externally threaded upper end portion of the tube guide 34*b*. A nipple 40*a*, having an externally threaded end portion, extends from the upper end of the stripper 40 and through an opening (not shown) in the upper frame member 30*d* of the frame assembly 30. The stripper 40 has a relatively small-diameter internal bore especially adapted to accommodate coiled tubing and its function, along with that of the tube assembly 34, will be described in detail.

A frame assembly 46 extends above the frame assembly 30 and consists of a base member 46*a*, four upright members, two of which are shown by the reference numerals 46*b* and 46*c*, and an upper frame member 46*d*. The upper end portions of the upright members, including members 46*b* and 46*c*, project above the frame member 46*d* and the lower end portions of the upright members project below the base member 46*a*. Four caps 46*e* are provided on the respective lower end portions of the upright members, including the members 46*b* and 46*c*, with the caps extending over the projecting end portions of the corresponding upright members, including the members 30*b* and 30*c*, of the frame assembly 30. The caps 46*e* are connected to the latter end portions in any conventional manner as described above.

A nipple 47 extends downwardly from the base member 46*a* of the frame assembly 46 and a connector 48 extends rom the nipple 47 and engages the nipple 40*a* extending from the stripper 40. Each connector 38, 42 and 48 may be in the form of a quick union collar which threadedly engages the externally-threaded portion of the nipple 28*b*, the tube guide 34*b* and the stripper 40, respectively, so that as the collar advances on the latter end portions, it forces a wedge member, or the like (not shown) into locking engagement with the end portions. Since this is conventional the quick union connector will be not be shown or described in any further detail.

An injector 50 is disposed within the frame assembly 46 and can be of any conventional design such as an endless belt, a snubber, or the like for handling coiled tubing as will be described. Examples of injectors that can be used are disclosed in U.S. Pat. Nos. 3,866,679, 3,999,610 and 4,655,291, the disclosures of which are incorporated by reference. A preferred injector is hydraulically operated and has pressure beams which define a central longitudinal opening for receiving the tubing to be injected and which can be adjusted to vary the size of the opening, for reasons that will be described. In order to further support the injector 50, the frame assembly 46 includes a pair of cross pieces **46*f* and 46*g* extending between the upright members including the members 46*b* and 46*c***.

A frame assembly 52 extends above the frame assembly 46 and is formed by a base member **52*a*, four upright members, two of which are shown by the reference numerals 52*b* and 52*c*, and an upper frame member 52*d*. The upper end portions of the upright members, including the members 52*b* and 52*c*, project above the frame member 52*d* and the lower end portions of the upright members project below the base member 52*a*. Four caps 52*e* are provided on the respective lower end portions end of the upright members, including the members 52*b* and 52*c*, and the latter caps respectively extend over the projecting end portions of the corresponding upright members, including the members 46*b* and 46*c* of the frame assembly 46. The caps 52*e* are connected to the latter end portions in any conventional manner as described above. An injector 54 is supported in the frame assembly 52 and can be identical to the injector 50 supported in the frame assembly 46. In order to further support the injector 54 the frame assembly 52 includes cross pieces 52*f* and 52*g* extending between the upright members, including members 52*b* and 52*c***.

Although only two injectors 50 and 54, along with their respective frame assemblies 46 and 52, are shown and described, it is understood that additional injectors and frame assemblies can be provided above the injector 54 as needed.

A base support 56 extends over the upper projecting end portions of the upright members, including members **52*b* and 52*c* of the frame assembly 52 for supporting a guide 60 which operates to guide coiled tubing 62 into the injector 54 in a conventional manner. The coiled tubing 62, which is normally stored on a reel, or the like, located on the ground surface, can be introduced into the guide 60 and thus passes into the injectors 54 and 50 whereby it is driven downwardly through the stripper 40, the telescoping tube assembly 34, the annular blow-out preventor 28, the blow-out preventor 16, the valve assembly 14 and into the wellbore 12 for performing work such as, for example, washing or the like. The stripper 40, with its relatively small-diameter internal bore seals against any fluid leakage around the outer surface of the coiled tubing 62**.

According to a main feature of the present invention, after the operation of the coiled tubing 62 is complete, a wireline tool can be inserted into a pressure-containing lubricator having a larger diameter than that of the coiled tubing 62 and the lubricator can be inserted into the wellbore 12 without removing the unit depicted in FIG. 1. To this end, the coiled tubing 62 is pulled up through the blow-out preventors 16 and 28 which are then closed to seal off the high pressure well fluid. The coiled tubing 62 is then pulled up further through the telescoping tube assembly 34, the stripper 40, and the injectors 50 and 54, and then removed from the guide 60.

The connectors 38 and 48 are then released, and the hydraulic ram 35 actuated, to collapse the telescoping tube assembly 34 after which the assembly including the retracted tube assembly 34, the stripper 40 and the connector 38 is raised slightly so that the connector 38 clears the nipple **28*b*. The ram 35 is disconnected from the plate 36 and the plate is pivoted about the beam 37 so that the letter assembly is swung out from coaxial alignment with the remaining components. The tool to be inserted is placed in a lubricator and wireline is connected to the upper end portion of the tool and projects upwardly through the upper end of the lubricator in a sealing relationship. The lubricator can be a conventional oil well service device which allows wireline to project through its upper end through a packing gland. The wireline would extend over a sheave and attach to the driven spool of a remotely-located wireline service unit. Since this technique of placing a tool in a lubricator and attaching wireline to the tool is conventional, these components are not shown in FIG. 1** for the convenience of presentation.

Figure 2:
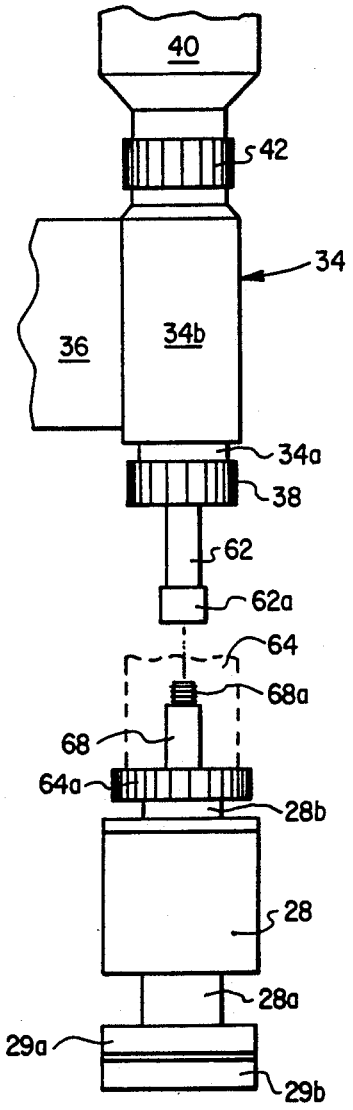
FIG. 2 is an enlarged, partial view of the unit of FIG. 1 depicting an operational mode.
Figure 3:
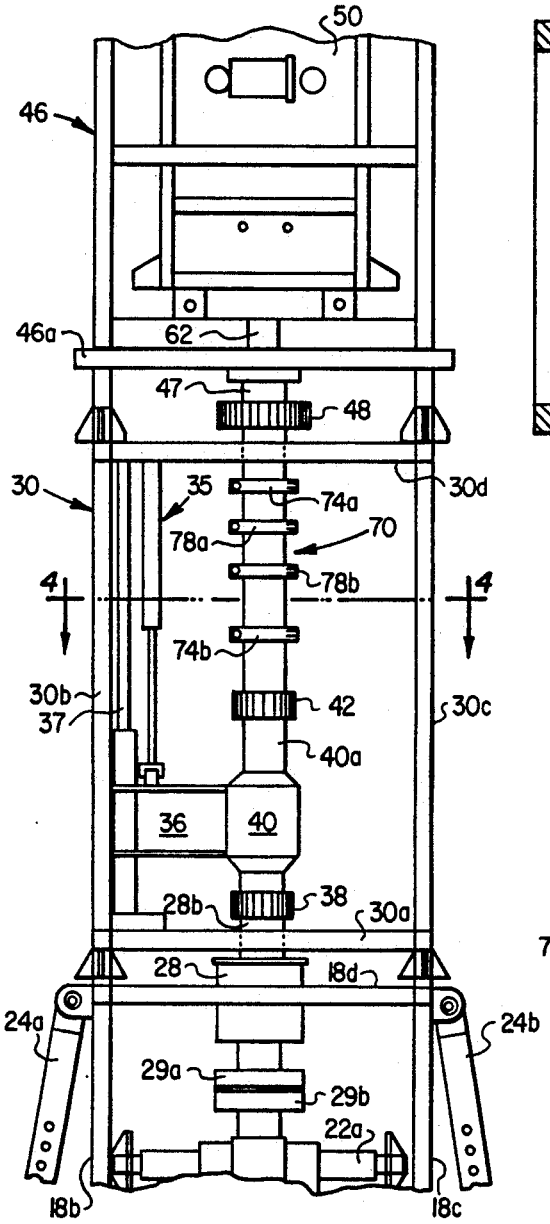
FIG. 3 is an enlarged partial, front elevational view similar to FIG. 2 but depicting a alternate embodiment of the present invention.

The injectors 50 and 54 are then opened and the lubricator, containing the tool, is passed by the force of gravity, through the injectors 50 and 54 whose pressure beams are designed to accommodate and support the relatively large diameter lubricator. This continues until the lower end portion of the lubricator, which is referred to by the reference numeral 64 in FIG. 2, is positioned just above the nipple **28*b* of the blow-out preventor 28. The pressure beams of the injectors 50 and 54 may be closed to support the lubricator 64 and a connector 64*a*, which may be in the form of a quick union collar, is provided on the lower end of the lubricator 64 Which engages the externally-threaded end portion of the nipple 28*b***.

The blow-out preventor 16 (FIG. 1) is then opened so that the well fluid pressure is equalized between the lubricator 64 and the components extending below it. The tool contained in the lubricator 64 is referred to by the reference numeral 68 in FIG. 2 and has a reduced-diameter, externally-threaded, end portion **68*a*. The tool 68 is lowered, by the wireline, under the force of gravity and moves relative to the lubricator 64 to a predetermined position in which it partially extends into the wellbore 12 with its upper end portion projecting above the nipple 28*b* of the blow out preventor 28** as shown.

The blow out preventors 16 and 28 are then closed, the wireline is disconnected from the tool 68 and the lubricator 64 is removed by an upward force applied by a crane or the like (not shown). Thus the tool 68 is left in the position shown in FIG. 2, i.e. with its end portion, including the threaded portion **68*a*, projecting out from the nipple 28*b*. The assembly including the retracted telescoping tube assembly 34, the stripper 40 and the connector 38 is then swung back into place as shown in FIG. 2 and the telescoping tube assembly is extended sightly by action of the ram 35 so that the upper connector 48 (FIG. 1) can be connected to the upper end portion of the stripper 40. In this mode the threaded end portion 68*a* of the tool 68 is slightly spaced from the lower connector 38 as shown in FIG. 2**.

The coiled tubing 62, which has an internally threaded connector **62*a* attached to its leading end, is then inserted through the tube guide 60 and driven downwardly by the injectors 54 and 50 into and through the stripper 40 and the collapsed telescoping joint assembly 34 until the connector 62*a* can be connected to the threaded end portion 68a of the tool 68, with FIG. 2 depicting the coiled tubing 62 just prior to this connection. The connector 48 is then disconnected from the upper end of the stripper 40 and the hydraulic ram 35 (FIG. 1) is actuated to lower the collapsed tube assembly 34 over the connection between the reeled tubing 62 and the tool 68, so that the connector 38 can be reconnected to the externally threaded end portion of nipple 28b. The tube assembly 34 is then raised by the ram 35 and thus expanded until the connector 48 can be reconnected to the stripper 40**.

The blow out preventors 16 and 28 are then opened so and the well fluid pressure is contained by the stripper 40. Thus, the relatively large diameter lubricator 64 and the tool 68 can be accommodated notwithstanding the fact that the stripper 40, which is sized to accommodate smaller diameter coiled tubing is maintained in the system. It is understood that several tool and lubricator sections can be inserted into the wellbore 12 in the foregoing manner.

Thus the service unit and method of the present invention enjoys the advantage of permitting coiled tubing operations yet permitting conversion to to relatively large diameter tools without removal of the unit or major components of the unit. This is achieved by opening the pressure beams of the injectors to increase the capacity for adding larger-diameter tools to the drill string as described above. In this context, the frame assembly 30 establishes a "service window" below the injectors 50 and 54 and above the blow-out preventors 16 and 28 which functions as a work platform and enables the aforementioned disconnections and connections to be made. Thus the larger-diameter tools can be inserted into, and removed from, the wellbore in a safe and expeditious manner. Further, the load from the stack of components extending above the valve 14 is not applied to the wellbore 12 but is transferred, via the frame assemblies 18, 30, 46 and 52 to ground thus deflecting the load from the wellbore 12 and eliminating the need for a crane, or other external support device, during operation. Still further, additional frame assemblies can be provided above the frame assembly 52 for supporting additional injectors above the injector 54. In this manner all of the injectors can be used when the lifting requirements so dictate or, in application requiring less lifting power, all of the hydraulic power can be diverted to one injector to permit greater lifting speeds.

The embodiment of FIGS. 3–6 include components of the previous embodiment which are given the same reference numerals. According to the embodiment of FIGS. 3–6, the telescoping tube assembly 34 of the previous embodiment is replaced by a tubing guide, shown in general by the reference numeral 70, which is connected above the stripper 40 and between the connectors 42 and 48. The stripper 40 is connected between the connectors 38 and 42 and to the plate 36 which, as in the previous embodiment, is pivotally connected to the beam 37.

Figure 4:
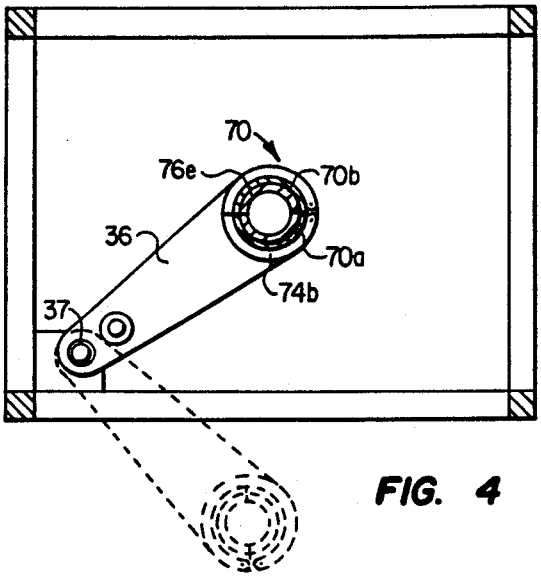
FIG. 4 is a cross-sectional view taken along the line 4—4 of FIG. 3.
Figure 5:
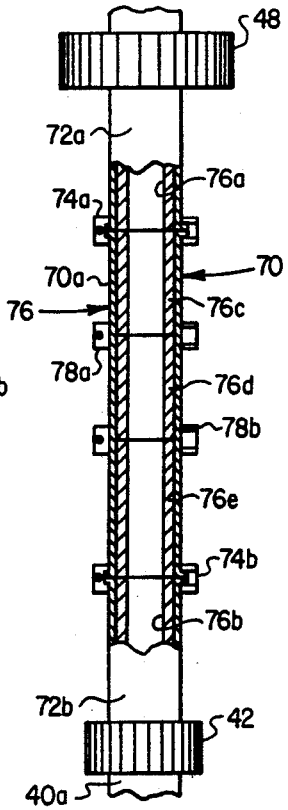
FIG. 5 is an enlarged sectional elevational view of the tubing guide of FIG. 3.
Figure 6:
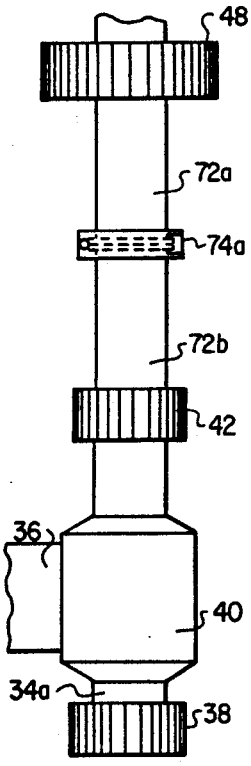
FIG. 6 is an enlarged elevational view of the tubing guide of FIG. 3 in a different mode.

As better shown in FIG. 4, the tubing guide 70 consists of two arcuate plates 70a and 70b pivotally connected by a hinge (not shown) along corresponding edge portions in a conventional manner so that the plates can be pivoted towards each other to form a hollow cylinder. Referring to FIGS. 5 and 6, the tubing guide 70 extends between an upper nipple 72a and a lower nipple 72b. The upper end portion of the upper nipple 72a connected to the connector 48, and the lower nipple 72b is connected, via the connector 42, to the nipple 40a extending from the upper end of the stripper 40. These connections to the connectors 42 and 48 are identical to those described in connection with the previous embodiment.

The lower end portion of the upper nipple 72a is connected to the upper ends of the arcuate plates 70a and 70b by a circular, pivoted clamp 74a (FIG. 5). The clamp 74a extends over abutting flanges respectively formed on the nipple 72a and the plates 70a and 70b and since the clamp 74a is conventional, it will not be described in any further detail. The lower ends of the plates 70a and 70b are connected to the upper end of the lower nipple 72b by a clamp 74b in the same manner as described above.

A tubular insert 76 extends within the nipples 72a and 72b and the cylinder formed by the plates 70a and 70b. The insert 76 is formed by two cylinderical segments 76a and 76b respectively extending within the nipples 72a and 72b, and three stacked cylinderical segments 76c, 76d and 76e extending with the cylinder formed by the arcuate plates 70a and 70b. Each cylinder segment 76a-76e is formed by two split arcuate segments as shown in FIG. 4 in connection with the segment 76e. Two spaced clamps 78a and 78b which are similar to the clamps 74a and 74b, extend around the cylinder formed by the arcuate plates 70a and 70b to further secure the assembly in the position shown in the drawings. The tubing guide 70 thus defines a small-diameter, internal bore to guide the coiled tubing 62 from the lower injector 50 to the stripper 40 while preventing any fluid leakage around the outer surface of the coiled tubing.

When it is desired to convert the embodiment of FIGS. 3–6 from a coiled tubing operation to a wireline tool operation, the coiled tubing is removed from the unit as described in connection with the previous embodiment and the blow out preventors 16 and 28 are closed. The clamps 74a, 74b, 78a and 78b are then released, the arcuate plates 70a and 70b are disconnected and the segments 76a–76e are removed. The connector 38 is disconnected from the nipple 28a and the ram 35 is activated to raise the stripper 40, the connector 42 and the lower nipple 72b until the latter abuts the upper nipple 72a as shown in FIG. 6. The clamp 74a is then connected over the juncture between the nipples 72a and 72b to secure the nipples together.

The connector 48 is then disconnected from the upper nipple 72a and the plate 36 is pivoted about the beam 37 so that the assembly consisting of the connectors 38 and 48, the stripper 40, and the connected nipples 72a and 72b, is swung out of coaxial alignment with the remaining components. The lubricator 64 and the wireline tool 68 (FIG. 2) are then inserted into the wellbore 12, the pressure equalized, the tool 68 lowered, the blow-out preventors 16 and 28 closed and the lubricator 64 removed as described in connection with the previous embodiment. The assembly consisting of the connectors 38 and 42, the stripper 40 and the nipples 72a and 72b are then swung back into coaxial alignment with the remaining components and the connectors 38 and 48 connected to the nipples 28b and 47, respectively. The coiled tubing 62 is reinserted into the unit, lowered and connected to the tool 68 as also described in connection with the previous embodiment. The blow-out preventors 16 and 28 are opened and the stripper 40 contains the well fluid pressure so that the tool 68 can be operated as described above. Thus, as in the previous embodiment, the relatively large-diameter lubricator 64 and the tool 68 can be accommodated while the stripper 40 can be maintained in the unit.

Figure 7:
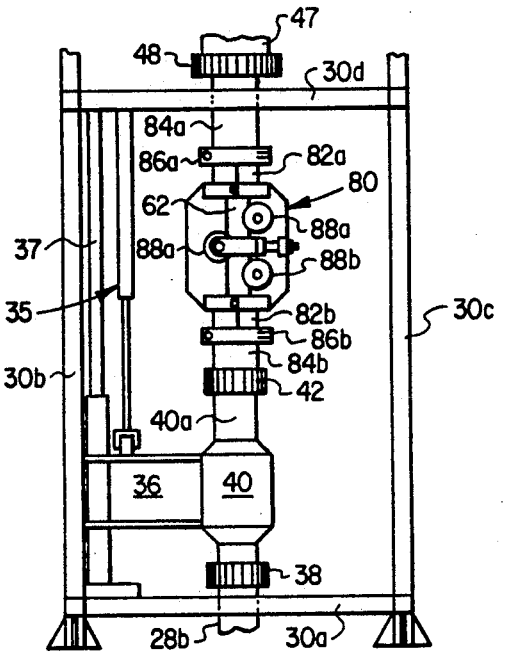
FIGS. 7 and 8 are views similar to FIG. 3, but depicting alternative embodiments of the present invention.

The embodiment of FIG. 7 is identical to that of FIGS. 3–6 with the exception that the tubing guide 70 of FIGS. 4 and 5 has been replaced by a tube straightener, shown in general by reference numeral 80. The tube straightener 80 has a pair of nipples 82*a* and 82*b* extending from its respective ends which are connected, via an upper nipple 84*a* and a lower nipple 84*b*, to the connectors 48 and 42, respectively. A pair of clamps 86*a* and 86*b*, identical to the clamps previously described, are disposed at the juncture of the nipples 82*a* and 84*a* and at the juncture of the nipples 82*b* and 84*b*, respectively. The nipple 84*b* is connected, via the connector 42, to the nipple 40*a* extending from the upper end of the stripper 40. The plate 36 extends between the stripper 40 and the beam 37 as in the previous embodiment.

The purpose of the tube straightener 62 is to compensate for any slight bends in the coiled tubing 66 as a result of being passed through the curved guide 60 and the injectors 50 and 54 (FIG. 1). To this end, the tube straightener 80 includes two fixed rollers 88*a* and 88*b* engaging one sidewall of the coiled tubing 62 and an adjustable roller 88*c* engaging the opposite sidewall so that, when the coiled tubing 62 is passed downwardly through the straightener 80, it is straightened. Since the stripper 40 extends below the straightener 80, the latter does not require pressure connections. Since the straightener 80 is of a conventional design it will not be described in any further detail.

To convert the embodiment of FIG. 7 from a coiled tubing operation to a wireline tool operation, the coiled tubing 62 is removed from the unit as described in connection with the embodiment of FIGS. 1 and 2 and the straightener 80 is removed by disconnecting the clamps 86*a* and 86*b*. The connector 38 is disconnected from the nipple 28*b* and the stripper 40 is raised by the ram 35 until the nipple 84*b* abutts the nipple 84*a*. The clamp 86*a* is then placed around the juncture of the nipples 84*a* and 84*b*, the connector 48 is disconnected from the nipple 84*a* and the assembly including the stripper 40, the nipples 84*a* and 84*b*, the clamp 86*a* and the connectors 38 and 48 are swung outwardly about the beam 37 to clear the space. The lubricator 64, containing the tool 68 (FIG. 2), is inserted into the wellbore 12 the pressure equalized, the tool 68 lowered, the blow-out preventors 16 and 28 activated, and the lubricator 64 removed, all in the manner described in connection with the previous embodiments. The above-mentioned assembly is then swung back into coaxial alignment with the remaining components and the connectors 38 and 48 are connected to the nipples 28*b* and 47, respectively. The coiled tubing 62 is then reinserted into the unit, lowered and connected to the tool 68, the blow-out preventors 16 and 28 opened and the stripper 40 contains the well fluid pressure as also described in connection with the previous embodiments. The embodiment of FIG. 7 thus permits conversion from a coiled tubing operation to a wireline tool operation with a minimum of structural changes while permitting the coiled tubing to be straightened.

Figure 8:
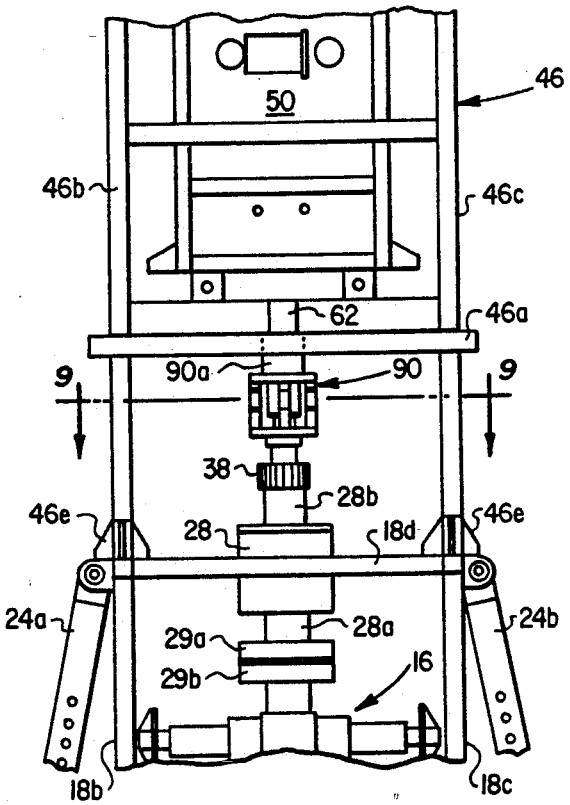
Figure 9:
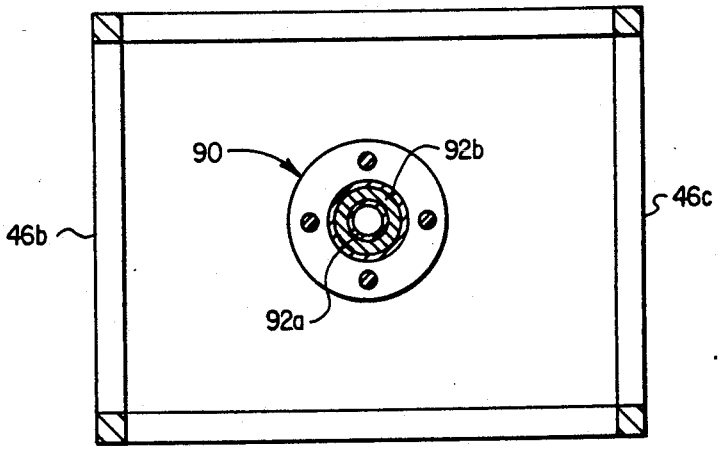
FIG. 9 is an enlarged cross-sectional view taken along the line 9—9 of FIG. 8.

The embodiment of FIGS. 8 and 9 eliminates the need for removing a component from the stack of components yet renders it possible to substitute a tool (including a lubricator) in place of the coiled tubing. More particularly, the frame 30 of the previous embodiments is eliminated and lower end portions of the legs 46*b* and 46*c* (and the other two legs not shown in FIG. 7) engage the cross member 18*d* of the frame assembly 18 via the caps 46*e*. The stripper 40 and the tube straightener 80 of the previous embodiment are eliminated and a side door stuffing box assembly, shown in general by the reference numeral 90, is connected between the base member 46*a* of the frame assembly 46 and the annular blow out preventor 28. More particularly, a tube guiding nipple 90*a* extends from the upper end of the stuffing box assembly 90 and through an opening (not shown) in the beam member 46*a*, and the connector 38 extends from the lower end of the stuffing box assembly and is connected to the nipple 28*b* of the blow-out preventor 28. As shown in FIG. 9 the stuffing box assembly 90 is provided with an inner annular sealing element 92*a* extending within an outer annular sealing element 92*b* it being understood that the nipple 90*a* is also provided with similar sealing elements all of which are designed to accommodate the coiled tubing 62.

The stuffing box assembly 90 operates in a conventional manner and includes a door (not completely shown in the drawings) which opens to permit access to the interior of the stuffing box assembly 90 and the nipple 90*a*. Therefore, when it is desired to convert from a coiled tubing operation to a tool operation, the coiled tubing 62 is retracted completely from the injectors 50 and 54 as described in connection with the embodiment of FIGS. 1 and 2, and the elements 92 of the stuffing box assembly 90 and the corresponding elements of the tube guiding nipple 90*a* are removed. The lubricator 64 and the tool 68 are then inserted into the wellbore 12, the pressure equalized, the tool 68 lowered, the blow-out preventors 16 and 28 closed, and the lubricator 64 removed as described in connection with the previous embodiments. The coiled tubing 62 is then inserted and connected to the tool 68 and the elements 92*a* and 92*b* of the stuffing box assembly 90 and the corresponding elements of the tube guiding nipple 90*a* are reinstalled within the assembly 90 and the nipple 90*a* and over the coiled tubing 62. The blow-out preventors 16 and 28 then can be opened and the assembly 90 and the nipple 90*a* contain the well fluid pressure.

Thus the use of the stuffing box assembly 90 thus permits conversion from a coiled tubing operation to a tool operation without removing any components from the stack of components.

Several variations may be made in the foregoing without departing from the scope of the invention. For example the stuffing box assembly 90 of the embodiment of FIGS. 8 and 9 can be bolted directly to the beam 46*a*. Also, the number of frame assemblies, and therefore the number of injectors, stacked over the lower frame assembly 18 can be varied.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A method of operating an oil and gas well service unit having a string of components coaxially aligned above said well and including an injector for injecting coiled tubing in said well and sealing means for receiving said coiled tubing in a manner to seal against the discharge of fluid from said well, said method comprising the steps of injecting said coiled tubing through said string of components and into said well for performing work, removing said coiled tubing from said string of components, disconnecting said sealing means from said string of components while maintaining said injector in said string of components, inserting into the string of remaining components a tool assembly having a diameter greater than that of said coiled tubing, reconnecting said sealing means into said string of components, reinjecting said coiled tubing into said string of components, and connecting said coiled tubing to said tool assembly so that said coiled tubing and said tool assembly can be injected into said well.

2. The method of claim 1 wherein said string of components includes a blow-out preventor and further comprising the step of closing said blow-out preventor before said step of disconnecting, and opening said blow-out preventor after said step of inserting.

3. The method of claim 1 wherein said tool assembly includes a lubricator and a tool sealingly disposed within said lubricator, and further comprising the step of lowering said tool relative to said lubricator and at least partially into said well after said step of inserting.

4. The method of claim 3 wherein said string of components includes a blow-out preventor and further comprising the steps of closing said blow-out preventor before said step of disconnecting, and opening said blow-out preventor before said step of lowering.

5. The method of claim 4 further comprising the step of closing said blow-out preventor after said step of lowering and then removing said lubricator from said string of components.

6. The method of claim 5 wherein said step of connecting is after said latter step of removing.

7. The method of claim 1 wherein said tool assembly is inserted through, and supported by, said injector.

8. The method of claim 1 wherein said step of disconnecting comprises the step of collapsing said sealing means and pivoting said collapsed sealing means out of alignment with said string of remaining components.

9. The method of claim 1 wherein said sealing means is in the form of a stuffing box assembly and wherein said step of disconnecting comprises the step of removing sealing elements from said stuffing box assembly.

10. The method of claim 1 further comprising the step of straightening said coiled tubing as it passes through said string of components.

11. A service unit for an oil and gas well including a string of components coaxially aligned above said well and injector means for injecting coiled tubing into said well, said unit comprising frame means for supporting said string of components, sealing means supported by said frame means and connected in coaxial alignment with said string of components for receiving said coiled tubing in a manner to seal against the discharge of fluid from said well, said sealing means adaptable to be disconnected from said string to permit a tool having a larger diameter than that of said coiled tubing to be inserted into said string.

12. The unit of claim 11 wherein said sealing means is reconnectable in said string of components to permit to said coiled tubing to be connected to said tool.

13. The unit of claim 11 wherein said sealing means comprises a stripper and a collapsible tube guide connected to said stripper.

14. The unit of claim 13 wherein said stripper is connected between said injecting means and said collapsible tube guide.

15. The unit of claim 13 wherein said collapsible tube guide is connected between said injecting means and said stripper.

16. The unit of claim 13 wherein said collapsible tube guide comprises two telescoping members adapted for axial movement relative to each other.

17. The unit of claim 16 further comprising means supported by said frame means for telescoping said telescoping members relative to each other to collapse said collapsible tube guides.

18. The unit of claim 13 wherein said collapsible tube guide comprises a plurality of stacked segments and clamp means for clamping said segments together, said tube guide being collapsible by removing some of said segments.

19. The unit of claim 12 further comprising pivot means connected to said frame means and to said sealing means for permitting said sealing means to be pivoted from said coaxial alignment and pivoted back into said coaxial alignment.

20. The unit of claim 11 wherein said sealing means comprises a stuffing box and a plurality of sealing members disposed in said stuffing box, said sealing members being removable from said stuffing box to disconnect said sealing means from said string.

21. A service unit for an oil and gas well comprising a first frame means, means extending from the ground surface adjacent the upper end of said well for supporting said first frame means over, and in a spaced relationship to, said well, a second frame means extending above said first frame means, means associated with said first and second frame means for permitted said first frame means to support said second frame means and permitting said second frame means to support additional frame means, and injector means supported by said second frame means for injecting tubing through said first frame means and into said well, said supporting means transferring the load from said frame means and said injector means to said ground.

22. The service unit of claim 21 wherein said first frame means comprises a plurality of upright frame members spaced apart to permit access to said tubing to enable tools to be connected to said tubing.

* * * * *